United States Patent [19]

Hama et al.

[11] Patent Number: 4,563,879

[45] Date of Patent: Jan. 14, 1986

[54] HEAT PUMP WITH CAPILLARY TUBE-TYPE EXPANSION DEVICE

[75] Inventors: Hiroaki Hama; Masami Imanishi, both of Wakayama; Naoki Tanaka, Itami, all of Japan

[73] Assignee: Mitsubishi Denki Kabushiki Kaisha, Tokyo, Japan

[21] Appl. No.: 736,357

[22] Filed: May 21, 1985

[30] Foreign Application Priority Data

May 23, 1984 [JP] Japan ..... 59-106736
May 23, 1984 [JP] Japan ..... 59-106737

[51] Int. Cl.[4] ..... F25B 13/00

[52] U.S. Cl. ..... 62/160; 62/222; 62/324.1; 62/324.6; 62/504

[58] Field of Search ..... 62/160, 324.1, 324.6, 62/222, 223, 504

[56] References Cited

U.S. PATENT DOCUMENTS

| | | | |
|---|---|---|---|
| 3,264,837 | 8/1966 | Harnish | 62/222 X |
| 3,421,337 | 1/1969 | Johannsen | 62/160 X |
| 3,677,028 | 7/1972 | Raymond | 62/222 X |
| 3,884,663 | 5/1975 | Funaro | 62/222 |
| 4,373,353 | 2/1983 | Anzalone | 62/504 X |

FOREIGN PATENT DOCUMENTS

| | | |
|---|---|---|
| 58-28960 | 2/1983 | Japan . |
| 58-28961 | 2/1983 | Japan . |

*Primary Examiner*—Lloyd L. King
*Attorney, Agent, or Firm*—Leydig, Voit & Mayer Ltd.

[57] ABSTRACT

A heat pump employing a capillary tube as an expansion device is disclosed. The main throttle portion of the heat pump comprises a main capillary tube and a by-pass through which a portion of the refrigerant flows and cools the refrigerant flowing through the main capillary tube. A solenoid valve for controlling the flow of refrigerant through the main capillary tube is connected to the intake of the main capillary tube, and an electrical expansion valve is connected to the intake of the by-pass for controlling the flow therethrough. An auxiliary capillary tube for cooling and an auxiliary capillary tube for heating are connected in parallel with the main throttle portion, both capillary tubes having a higher resistance to flow than the main capillary tube. The auxiliary capillary tubes increase the range over which control of the flow of refrigerant can be achieved, allowing both a smaller flow of refrigerant during under minimum cooling or heating load as well as a larger flow of refrigerant under maximum cooling or heating load.

4 Claims, 2 Drawing Figures

HEAT PUMP WITH CAPILLARY TUBE-TYPE EXPANSION DEVICE

BACKGROUND OF THE INVENTION

The present invention relates to a heat pump, and more particularly to a heat pump employing a capillary tube to control refrigerant flow.

In a heat pump employing a simple capillary tube to control the flow of refrigerant, the range over which control is possible is limited, since the capillary tube is not adjustable. Accordingly, the idea has been conceived of increasing the range over which flow control can be performed by providing adjustable means for cooling the refrigerant as it flows through the capillary tube. If the two-phase refrigerant passing through the capillary tube is cooled, the amount of vapor in the refrigerant will be decreased by the cooling and accordingly the mass flow rate of the refrigerant will be increased. Therefore, by controlling the amount of cooling of the capillary tubes, the range of control of the flow through the capillary tubes can be considerably increased.

Japanese Laid-Open Patent Applications Nos. 58-28960 and 58-28961 disclose heat pumps in which the majority of the refrigerant is passed through a capillary tube, while a small portion of the refrigerant is passed through a controllable expansion valve and then passed through cooling pipes surrounding the capillary tube, thereby cooling the refrigerant passing through the capillary tube. The refrigerant passing through the capillary tube and the portion passing through the expansion valve are combined downstream of the capillary tube and together pass into the evaporator of the heat pump.

In those heat pumps, while the range of control of refrigerant flow is increased, it is not possible to achieve optimal refrigerant flow except in an intermediate operating range. Namely, since refrigerant always flows through the capillary tube even when the expansion valve is completely closed, more than the optimal amount of refrigerant will flow through the capillary tube when the cooling or heating load is low unless the diameter of the capillary tube is made extremely small. On the other hand, even if the expansion valve is fully opened, the amount of refrigerant which will flow through the capillary tube will be less than the optimal amount when the cooling load is very large unless the capillary tube is made large. Thus, with a single capillary tube, it is impossible to size it so that it will supply the optimal amount of refrigerant at both minimum and maximum load.

SUMMARY OF THE INVENTION

It is the object of the present invention to overcome the above-described drawbacks of conventional heat pumps employing capillary tubes for refrigerant flow control and to provide a heat pump in which refrigerant flow control can be performed over a wider range and in which the optimal flow of refrigerant can be achieved even when the load is very low or very high.

In a heat pump according to the present invention, an auxiliary heating capillary tube and an auxiliary cooling capillary tube are provided in parallel with a main capillary tube, the auxiliary capillary tubes having a higher flow resistance than the main capillary tube. A solenoid valve is provided at the inlet to the main capillary tube, and an electrical expansion valve is provided at the inlet of a by-pass through which flows refrigerant which cools the refrigerant in the main capillary tube. Control means control the opening of the solenoid valve and the electrical expansion valve in accordance with the cooling or heating load so that the refrigerant flow through the main capillary tube and the cooling tube can be appropriately regulated.

DESCRIPTION OF THE PREFERRED EMBODIMENT

An embodiment of a heat pump according to the present invention will now be described while referring to FIGS. 1 and 2, which are schematic views of this embodiment.

Figure 1:
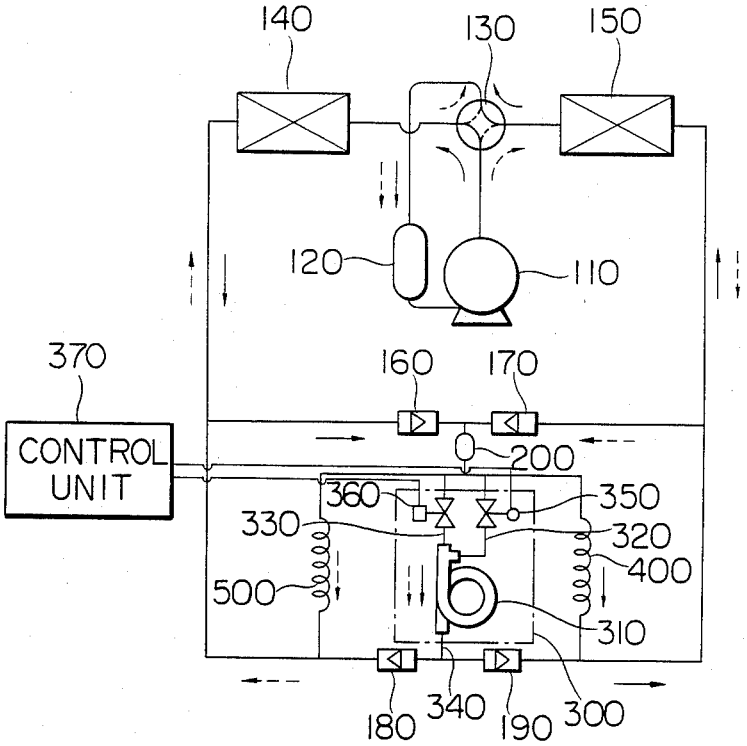
FIG. 1 is a schematic view of a heat pump according to an embodiment of the present invention.

As shown in FIG. 1, a compressor 110 having an accumulator 120 provided on its suction side is connected with an air-cooled heat exchanger 140 and a water-cooled heat exchanger 150 via a 4-way valve 130 so that refrigerant discharged from the compressor 110 can be passed to either the air-cooled heat exchanger 140 during cooling operation or to the water-cooled heat exchanger 150 during heating operation. The heat exchangers 140 and 150 are connected to the inlet of a drier 200 via a first check valve 160 and a second check valve 170 which are disposed so that refrigerant can flow through them only into the drier 200 and not in the opposite direction. The outlet of the drier 200 is connected to the inlet of a main throttle portion 300, and the outlet of the main throttle portion 300 is connected with the heat exchangers 140 and 150 via a third check valve 180 and a fourth check valve 190 which are oriented so that refrigerant can flow through them from the main throttle portion 300 to the heat exchangers but not in the opposite direction.

The main throttle portion 300 comprises a main throttle 310 which is connected to an electrical expansion valve 350 via a first intake pipe 320 and to a solenoid valve 360 via a second intake pipe 330. The electrical expansion valve 350 and the solenoid valve 360 are both connected to the discharge side of the drier 200. Furthermore, the main throttle 310 is connected to the upstream sides of the third check valve 180 and the fourth check valve 190 via a discharge pipe 340.

Figure 2:
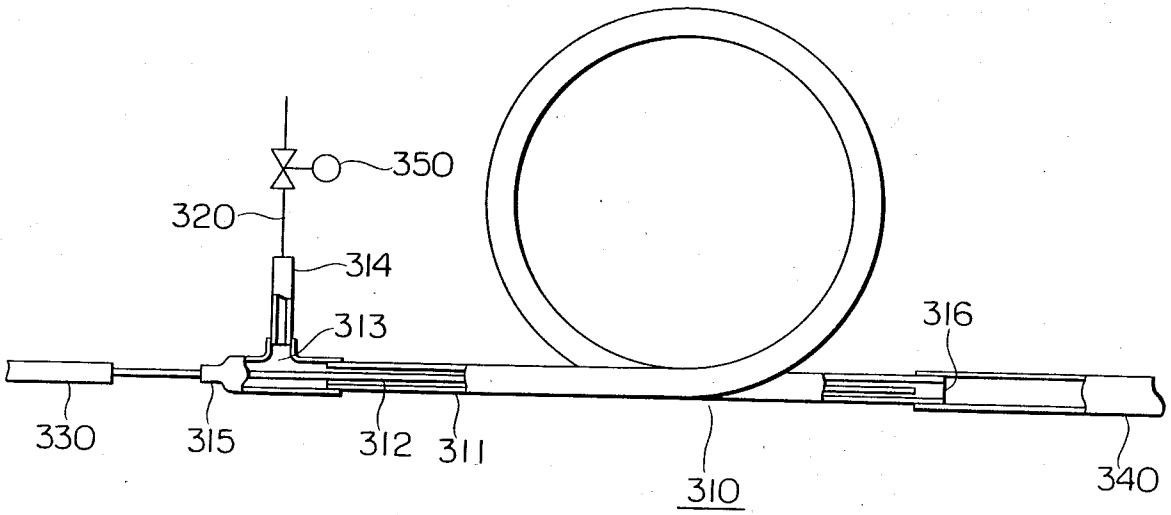
FIG. 2 is a schematic view partially in cross section of the main throttle portion of the embodiment of FIG. 1.

The structure of the main throttle 310 is shown in FIG. 2. An outer tube 311 bent into the shape of a loop houses a main capillary tube 312 inside a central cavity 313. The outer diameter of the main capillary tube 312 is smaller than the inner diameter of the outer tube 311 so that a passageway along which refrigerant can flow is formed along the entire length of the outer tube 311. The main throttle 310 has a first intake opening 314 which is sealingly connected to the first intake pipe 320 and which opens onto the central cavity 313 so that all refrigerant passing through the electrical expansion valve 350 passes into the central cavity 313. The main capillary tube 312 sealingly passes through a second intake opening 315 and sealingly connects to the second intake pipe 330 so that all refrigerant passing through the solenoid valve 360 enters the main capillary tube 312. The discharge opening 316 of the main throttle 310 is sealingly connected to the discharge pipe 340. The outer tube 311 thus acts as a by-pass and it together with the electrical expansion valve 350 serve as means for cooling the refrigerant flowing through the main capillary tube 312.

The electrical expansion valve 350 is controlled by a control unit 370 which detects the temperature of the outside air and the discharge water temperature of the water-cooled heat exchanger 150, and applies a suitable control signal to the electrical expansion valve 350 the voltage of which corresponds to the detected temperatures. The degree of opening of the electrical expansion valve 350 is determined by this control signal. Furthermore, the control unit 370 provides a control signal to the solenoid valve 360 which closes the valve 360 when the temperature of the discharge water of the water-cooled heat exchanger 150 is below a certain value during cooling, or when the temperature of the outside air is below a certain value during heating, and opens the valve 360 when these temperatures are above certain levels.

Between the output side of the drier 200 and the downstream side of the fourth check valve 190, an auxiliary cooling capillary tube 400 is provided in parallel with the main throttle portion 300. The auxiliary cooling capillary tube 400 has a flow resistance which is greater than that of the main capillary tube 312, and its size is chosen such that when the cooling load is at a minimum, it will alow the optimal flow rate of refrigerant through it.

Furthermore, between the output side of the drier 200 and the downstream side of the third check valve 180, an auxiliary heating capillary tube 500 is provided in parallel with the main throttle portion 300. The auxiliary heating capillary tube 500 has a flow resistance which is greater than that of the main capillary tube 312, and its size is chosen such that when the heating load is at a minimum, it will alow the optimal flow rate of refrigerant through it.

The operation of the apparatus during cooling will now be explained. The direction of flow of refrigerant during cooling is shown by the solid arrows. High temperature, high pressure refrigerant gas discharged from the compressor 110 passes through the 4-way valve 130, is condensed in the air-cooled heat exchanger 140, and the liquified refrigerant passes through the first check valve 160 and the drier 200. After the refrigerant leaves the drier 200, its flow path is determined by the operating conditions.

During cooling operation, the degree of opening of the electrical expansion valve 350 is determined by the discharge water temperature of the water-cooled heat exchanger 150 and the outside air temperature. When the cooling load is at a minimum level, both the electrical expansion valve 350 and the solenoid valve 360 are closed by the control unit 370 so that throttling of the refrigerant discharged from the compressor 110 is performed solely by the auxiliary cooling capillary tube 400. All of the refrigerant passes through the auxiliary cooling tube 400 and enters the water-cooled heat exchanger 150, where it is evaporated. It is then returned to the compressor 110 via the 4-way valve 130 and the accumulator 120.

As the cooling load increases, the electrical expansion valve 350 is gradually opened so as to increase the flow of refrigerant, which then flows through both the auxiliary cooling capillary tube 400 and the electrical expansion valve 350. The refrigerant which passes through the expansion valve 350 enters the first intake opening 314 and flows along the central cavity 313 of the main throttle 310 and then into the discharge pipe 340. It then passes through the fourth check valve 190 and is united with the refrigerant which passes through the auxiliary cooling capillary tube 400 and returns to the compressor 110 via the water-cooled heat exchanger 150 as described above.

If the cooling load increases to the point where the electrical expansion valve 350 is fully open and there is yet a further increase in cooling load, then the control unit 370 will close the electrical expansion valve 350 and open the solenoid valve 360 so that refrigerant can flow through the auxiliary cooling capillary tube 400 and the main capillary tube 312. To further increase the refrigerant flow, the control unit 370 once again gradually opens the electrical expansion valve 350 in correspondence with the load such that refrigerant flows through the auxiliary cooling capillary tube 400, the main capillary tube 312, and the passageway formed between the outer tube 311 and the main capillary tube 312. The opening of the electrical expansion valve 350 will increase the refrigerant flow not only by allowing refrigerant to flow through the central cavity 313, but it will also increase the flow of refrigerant through the main capillary tube 312 by cooling it. Namely, refrigerant which passes through the electrical expansion valve 350 is first decompressed by the valve 350 and then evaporates within the central cavity 313 of the outer tube 311, providing a cooling effect. This cooling effect decreases the quality of the 2-phase refrigerant flowing through the main capillary tube 312, and the mass flow rate is therefore increased. The refrigerant flowing through the main capillary tube 312 and that flowing through the central cavity 313 combine just before entering the discharge pipe 340 and then pass through the fourth check valve 190 to be combined with the refrigerant passing through the auxiliary cooling capillary tube 400. All of the refrigerant then returns to the compressor 110 via the water-cooled heat exchanger 150 as described above.

By the provision of the solenoid valve 360 at the inlet of the main capillary tube 312 and the auxiliary cooling capillary tube 400, the range over which refrigerant flow can be regulated is increased compared with a conventional device. Namely, with the solenoid valve 360 and the electrical expansion valve 350 both closed, a very small flow of refrigerant occurs through the auxiliary cooling capillary tube 400 which has a much higher flow resistance than does the main capillary tube 312. Furthermore, since three flow pathways are provided for refrigerant when both the electrical expansion valve 350 and the solenoid valve 360 are open, the maximum refrigerant flow is greater than in a conventional heat pump in which there is no auxiliary cooling capillary tube 400.

During cooling operation, when both of the valves 350 and 360 are closed, it is possible for some refrigerant to flow from the air-cooled heat exchanger 140 and through the auxiliary heating capillary tube 500 in the direction opposite to the dashed arrow. However, as the fluid resistance of the capillary tube 500 is much greater than the path through the first check valve 160 and the drier 200, almost all of the refrigerant flows through the first check valve 160 and the reverse flow through the auxiliary heating capillary tube 500 during cooling mode is inconsequential.

Next, heating operation will be explained. The direction of refrigerant flow is indicated by the dashed arrows. High temperature, high pressure refrigerant gas discharged from the compressor 110 is condensed in the water-cooled heat exchanger 150, and passes through the second check valve 170 and the drier 200. When the heating load is at a minimum, both the electrical expansion valve 350 and the solenoid valve 360 are closed, and all the refrigerant discharged from the compressor 110 flows through the auxiliary heating capillary tube 500. The capillary tube 500 is selected so that the optimal amount of refrigerant will flow through it at the minimum heating load. As the heating load increased, the control unit 370 causes the electrical expansion valve 350 to gradually open in correspondence with the increase in load with the solenoid valve 360 still shut, and when the expansion valve 350 is fully open, the expansion valve 350 will be shut and the solenoid valve 360 will be opened. Further increases in refrigerant flow are achieved by again gradually opening the electrical expansion valve 350 with the solenoid valve 360 open, and the cooling of the refrigerant passing through the main capillary tube 312 by the refrigerant passing through the central cavity 313 increases the flow through the main capillary tube 312. Thus, just as during cooling operation, the range over which optimal control of refrigerant flow can be performed is increased by the provision of the solenoid valve 360 and the auxiliary heating capillary tube 500, and the optimal flow of refrigerant can be achieved for a lower and a higher heating load than in a conventional apparatus in which refrigerant continually passes through a main capillary tube.

During heating operation, when both of the valves 350 and 360 are closed, it is possible for a small reverse flow of refrigerant to occur in the auxiliary cooling capillary tube 400 in the direction opposite to that indicated by the arrow. However, as the flow resistance through the auxiliary cooling capillary tube 400 is very high compared to that through the second check valve 170 and the drier 200, this reverse flow is extremely small and of no significance.

Next, defrost operation will be explained. Refrigerant flow during defrost operation is indicated by the solid arrows and is the same as during cooling. However, during defrost operation the difference between high and low pressure is small, so that the optimal refrigerant circulation is not guaranteed. Accordingly, the control unit 370 for the valves fully opens both the electrical expansion valve 350 and the solenoid valve 360 so as to carry out defrosting as quickly as possible.

What is claimed is:

1. A heat pump apparatus comprising:

a compressor;

a first heat exchanger connected to the discharge side of said compressor;

a second heat exchanger connected to the suction side of said compressor;

a main capillary tube connected between said first heat exchanger and said second heat exchanger;

adjustable means for cooling refrigerant flowing through said main capillary tube;

a solenoid valve connected to the intake side of said main capillary tube;

means for controlling the opening and closing of said solenoid valve in accordance with operating conditions;

an auxiliary cooling capillary tube which is connected in parallel with said main capillary tube between said first heat exchanger and said second heat exchanger and which has a higher resistance to flow than said main capillary tube; and an auxiliary heating capillary tube which is connected in parallel with said main capillary tube and said auxiliary cooling capillary tube between said first heat exchanger and said second heat exchanger and which has a higher resistance to flow than said main capillary tube.

2. A heat pump as claimed in claim 1, wherein said means for cooling refrigerant flowing through said main capillary tube comprises:

a by-pass which is connected in parallel with said main capillary tube between the intake side of said solenoid valve and the discharge side of said main capillary tube so that a portion of the refrigerant discharged from said compressor can pass through said by-pass and which is disposed so that refrigerant flowing therethrough can undergo heat exchange with refrigerant flowing through said main capillary tube;

an electrical expansion valve connected to the intake side of said by-pass; and means for controlling the degree of opening of said electrical expansion valve in accordance with operating conditions.

3. A heat pump as claimed in claim 2, wherein:

said by-pass comprises an outer tube which surrounds said main capillary tube for substantially its entire length whose inner wall is separated from the outer wall of said main capillary tube so that a passageway through which refrigerant can pass is formed between said inner wall of said outer tube and said outer wall of said main capillary tube;

said outer tube has a first intake opening which is connected to the discharge side of said electrical expansion valve and which opens onto said passageway such that refrigerant passing through said expansion valve passes through said passageway; and said outer tube has a second intake opening through which said main capillary tube sealingly passes, said main capillary tube being connected to the discharge side of said solenoid valve such that refrigerant passing through said solenoid valve passes through said main capillary tube.

4. A heat pump as claimed in claim 3, wherein one of said heat exchangers is a water-cooled heat exchanger, and said means for controlling said solenoid valve comprises:

first temperature sensing means for sensing the temperature of the discharge water which cools said water-cooled heat exchanger and producing a corresponding output signal;

second temperature sensing means for sensing the temperature of the outside air and producing a corresponding output signal; and means responsive to said output signals for opening said solenoid valve during cooling operation when the temperature of said discharge cooling water is above a first value and closing said solenoid valve when the discharge cooling water temperature is below said first value and for opening said solenoid valve during heating operation when the temperature of the outside air is above a second value and closing said solenoid valve when the temperature of the outside air is below said second value and for opening said solenoid valve during defrosting operation.

* * * * *